US007285716B2

(12) United States Patent
Gilmore et al.

(10) Patent No.: US 7,285,716 B2
(45) Date of Patent: Oct. 23, 2007

(54) AUTOMATED STRINGED INSTRUMENT PLAYER

(75) Inventors: Don A. Gilmore, Kansas City, MO (US); Thomas Allen Dolan, Naples, FL (US)

(73) Assignee: QRS Music Technologies, Inc., Naples, FL (US)

( * ) Notice: Subject to any disclaimer, the term of this patent is extended or adjusted under 35 U.S.C. 154(b) by 319 days.

(21) Appl. No.: 11/054,810

(22) Filed: Feb. 10, 2005

(65) Prior Publication Data

US 2005/0172779 A1 Aug. 11, 2005

Related U.S. Application Data

(60) Provisional application No. 60/543,186, filed on Feb. 10, 2004.

(51) Int. Cl.
*G10F 1/20* (2006.01)
*G10H 7/00* (2006.01)

(52) U.S. Cl. ..... 84/739; 84/8; 84/727

(58) Field of Classification Search ..... None
See application file for complete search history.

(56) References Cited

U.S. PATENT DOCUMENTS 5,212,330 A * 5/1993 Cooper ..... 84/320
5,323,680 A * 6/1994 Miller et al. ..... 84/455
5,497,690 A * 3/1996 Soupios ..... 84/453
6,723,904 B1 * 4/2004 Dolan et al. ..... 84/267
7,015,390 B1 * 3/2006 Rogers ..... 84/723

* cited by examiner

*Primary Examiner*—Marlon Fletcher
(74) *Attorney, Agent, or Firm*—Barnes & Thornburg, LLP; Glenn W. Ohlson

(57) ABSTRACT

An automated player for stringed instruments having a plucking mechanism and a fretting mechanism. The plucking mechanism includes a string contacting portion rotationally mounted relative to a corresponding instrument string with a rotational axis substantially perpendicular to the string, a first drive member for creating relative motion between the string and the string contacting portion. The fretting mechanism includes a carriage in depressive contact with the instrument string and a second drive member selectively positioning the carriage creating relative movement between the carriage and the string. The plucking mechanism and the fretting mechanism are attached to a frame which is attached to the instrument. The player includes an electronic control circuit that controls operation of the plucking and fretting mechanisms.

25 Claims, 5 Drawing Sheets

AUTOMATED STRINGED INSTRUMENT PLAYER

RELATED APPLICATIONS

This application claims the benefit of U.S. Provisional Application No. 60/543,186, filed Feb. 10, 2004.

BACKGROUND

The present disclosure relates to an automated player for playing stringed instruments. More specifically, the present disclosure relates to an automated apparatus for playing unmodified stringed instruments such as a guitar.

Stringed instruments, such as the modem guitar, are played by causing physical vibration to the strings of the instrument. The guitar has traditionally been played by setting the instrument in the musician's lap or suspending it from a strap over his shoulder and plucking or strumming the six strings with the right hand using either the fingertips or a small, plastic or tortoise-shell plectrum or "pick". Different musical notes are possible by pressing the individual strings against the front face of the neck or fingerboard of the guitar using the fingers of the left hand. When a string is depressed, it bridges over frets, raised metal ribs embedded in the fingerboard, and thus shortens the vibrating portion of the string and causes a higher musical pitch. Such is disclosed in U.S. Pat. No. 6,723,904, which is directed to an automated player and is incorporated herein in its entirety by reference.

DETAILED DESCRIPTION

The present disclosure is directed to an automated, electromechanical player that is separate and independent from the guitar 10, or other stringed instrument, and attaches to the neck or other suitable support position on the instrument. While the present disclosure is written in the context of a six string guitar, one skilled in the art will appreciate that the principles of the present disclosure are applicable to many stringed instruments having less than or greater than six strings. Further, one skilled in the art will appreciate that dimensions, design and layout of the preferred embodiment, which is directed to a player for six string guitars, is readily adaptable to stringed instruments of different shapes and sizes. The player can play pre-programmed music on the stringed instrument automatically without need of a musician. Since there are no human limitations such as only four fingers of the left hand to use at a time, music can be programmed and played by the player that would normally be impossible for an ordinary musician to play. When used in conjunction with an existing instrument, the device could also be used as accompaniment for a band or solo vocalist similar to the way a drum machine is used today.

Figure 1:
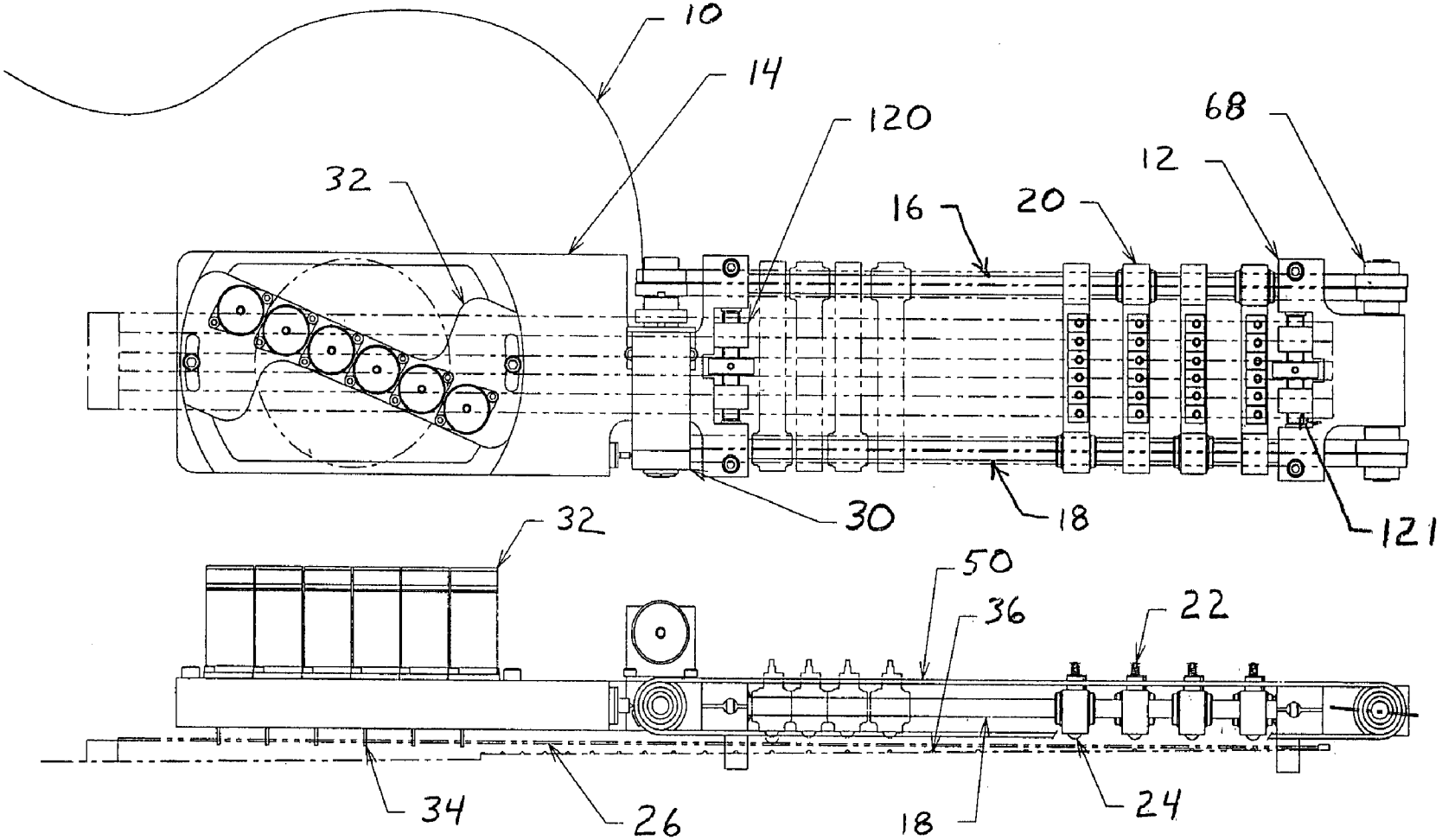
FIG. 1 shows the automatic player of the present disclosure attached to an instrument.

Referring to FIG. 1, the player comprises an upper frame 12 and a lower frame 14 between which are connected two cylindrical rails 16, 18, which are preferably metal. At least one, and preferably four carriages 20 slide on the rails using linear bearings 21. On each carriage, at least one and preferably six actuator solenoids 22 (one for each guitar string) are fastened. The actuator solenoid 22 operates a plastic or metal finger 24 pressing a string 26 down just like the left hand of a guitarist. Each carriage 20 is fastened to a timing belt, which is driven by a servomotor 30 that controls the fret position of the carriage 20 and thus the musical note produced.

Mounted to the lower frame is at least one and preferably a set of six individual rotary plucking mechanisms 32 (one for each string of the instrument). Each rotary plucking mechanism is dedicated to one string 26, such as one of the six strings on the guitar 10, and plucks the string by rotating a protruding quill 34 against the string, drawing the string back. The quill 34 then retracts to release the string and let the string vibrate freely. This mimics the action of the right hand of a guitarist. Since the quill 34 may be retracted at any given moment, the amount that the string is drawn, and thus the resulting amplitude/volume when released, is controllable.

Fretting Mechanism

The spacing between frets 36 on a guitar is not uniform. Since musical pitches are based on the ratios of frequencies between notes (and not the difference in frequency) musical tones of Western music are related to each other logarithmically. The smallest musical interval is the half-step or semitone (e.g. from C to C-sharp) and for any given note, the next note above can be calculated using $$f_2 = f_1 \times 2^{\frac{1}{12}} \cong 1.0595 f_1 \tag{1}$$

Where $f_1$=the frequency of a given note $f_2$=frequency of the next semitone above $f_1$ Since the frequency of a vibrating string is directly proportionate to its length, the vibrating length of a guitar string must be increased by this same ratio to achieve each successively lower musical semitone. Thus the spacing between consecutive frets of a guitar must be continually increased by the factor 1.0595 as they continue up the neck to obtain the proper musical pitches.

Figure 2:
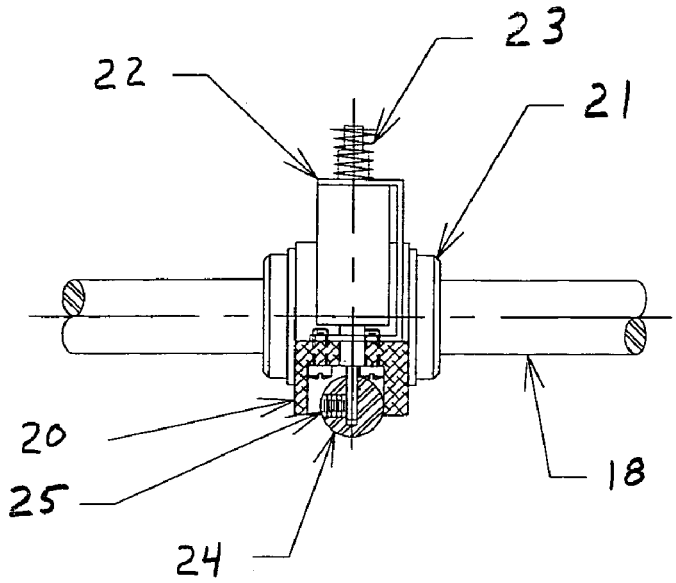
FIG. 2 is a side view of a fretting carriage.

Referring to FIG. 2, the player of the present disclosure executes fretting by contacting the string 26 of the instrument with a finger 24 comprising a cylindrical plastic or metal bar. The finger 24 is maintained in a retracted position, away for the string 26, by a spring 25. In executing a fretting operation, a control signal energizes the solenoid 22 overcoming the force of spring 25 which extends the finger 24 compressing the string 26. The string 26 is not compressed all the way to the fingerboard as when a guitarist plays, but is only lightly touched (slightly deflected from a normal rest position) so that the vibrating length of the string 26 is determined by the finger 24 itself and not by the fret 36 (which is never contacted). This is similar to what is known as "slide guitar" where the musician places a "bottle neck", or metal tube, on the strings when playing. This allows many special effects like vibrato and glissando that would otherwise be difficult or impossible for the player to perform. As a consequence, the carriages 20 must not only be precisely located over the string 26 when fretting, but must also expand and contract in relation to any other carriage, as they move up and down the neck in the ratio 1.0595 from equation (1).

To effect this proportional difference in motion of the four carriages of the preferred player for a six string guitar, a pulley system is included that approximates this ratio. The integer ratio of 18:17 is approximately equal to 1.0588. This results in an error of only 0.06% from the proper ratio, which is negligible. Thus, a timing pulley arrangement including timing pulleys 38 with this ratio of teeth are used to produce the proper positioning of the carriages.

Figure 3:
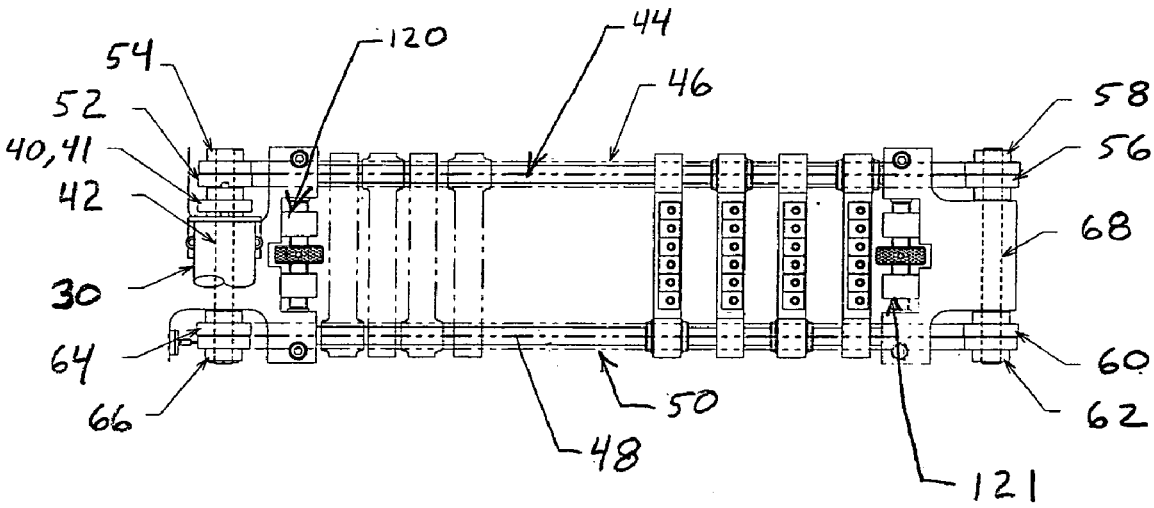
FIG. 3 is a plan view of a fretting carriage timing pulley arrangement.

FIG. 3 shows the timing pulley arrangement. A fretting motor 30 drives a first axle 42 with belts 44,46,48,50 on pulleys 52, 54, 56, 58, 60, 62, 64, 66. Drive pulleys 40, 41 are connected to the first axle 42. The numbers of teeth of these drive pulleys 40, 41 are arbitrary as they are for driving traction only. Pulleys 52 and 54 are rigidly connected to the first axle 42 and turn together. Since one pulley has 18 teeth and the other has 17 teeth the belts 44, 46 being driven by them will move in the ratio 18:17. In other words, when both pulleys are rotated one revolution, the 18-toothed pulley will pay out 18 teeth of belt 44 and the 17-toothed pulley will pay out 17 teeth of belt 46. If each of these belts is connected to a separate carriage, one carriage will move exactly 1.0588 times further than the other for any given move. If they are each positioned over adjacent frets at one end of the guitar neck and the motor drives them to the other end, they will still match the position of the frets even though they are much wider apart.

At the upper frame there are two pulleys, one for each belt 44, 46. Pulley 56, at the end of the faster belt 44, is an idler on bearings and its number of teeth is immaterial. Pulley 58, at the end of the slower belt 46, has 18 teeth and is rigidly connected to a second axle 68. At the other end of the second axle 68 are two more pulleys, 60 and 62. Pulley 60 is an idler and the axle has no effect on it. Pulley 62 is rigidly attached to the second axle 68 and has 17 teeth. So once again as pulley 60 takes up 18 teeth of belt 48 per revolution pulley 62 takes up only 17 and thus drives its belt 50 slower in the same ratio of 17:18 as before. A carriage attached to this belt would correspond to the next smaller fret.

The pulleys 64, 66 at the other end of these last two belts 48, 50, are rigidly connected to each other, but not to the first axle 42, which they rotate freely upon. Pulley 64 has 18 teeth; pulley 66 has 17 teeth. The belt 50 coming from pulley 62 is wrapped around pulley 66 and the last belt 48 (running back to the idler, pulley 60) is wrapped around pulley 64. Again the ratio 17:18 is applied to drive the last, slowest belt 48. The last carriage is attached to this belt. Now, as the motor drives these carriages, they will expand and contract together to exactly match the position of the frets, no matter where they are on the neck.

Plucking Mechanism

Figure 4:
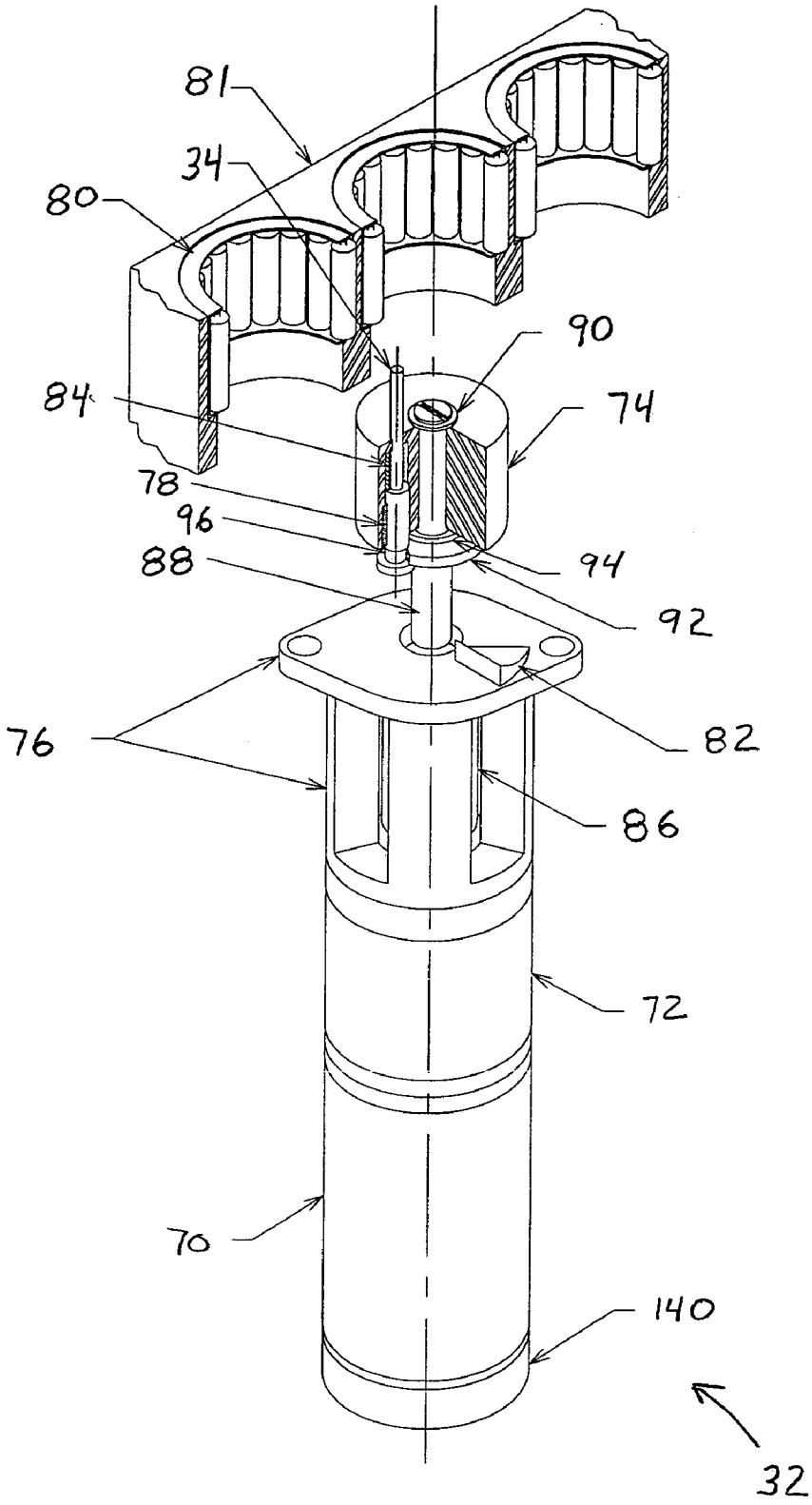
FIG. 4 is a perspective view of a rotary plucker.

To pluck the instrument strings, for each string the player includes a corresponding rotary plucker 32 that is positioned with its rotational axis perpendicular to the axis of the string 26 and located substantially directly above it. Each plucker of the preferred embodiment is as shown in FIG. 4.

A small servomotor 70/gearhead 72 combination rotates a plucking rotor 74. The plucking rotor includes an eccentric hole that accepts a spring-loaded shaft, or quill 34. The quill 34 is adapted to slide in a bushing 78 parallel to the axis of the rotor 74 and a quill head rides against the face of a coupling housing 76 of the servomotor 70/gearhead combination 72. An opposite, or string end of the quill 34 extends from the face of the rotor 74 and is used to pluck the guitar string. The rotor 74 rotates within a roller, or overrunning clutch 80 contained within a housing 81. The clutch 80 is similar to a needle bearing that only allows rotation in one direction. Thus, the rotor 74 is free to turn in the clockwise direction but will seize in the counter-clockwise direction.

As the rotor 74 turns in the free direction it eventually guides the quill head over a small ramp 82 on the surface of the coupling housing. As the rotor 74 continues to turn, the ramp 82 forces the quill 34 against the pressure of its spring 84, extending it.

Figure 5:
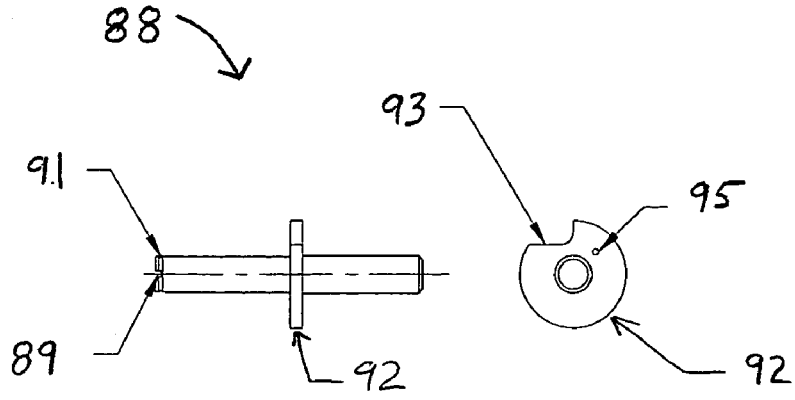
FIG. 5 shows a pawl shaft.

The shaft of the servomotor 70/gearhead 72 combination is attached to the rotor via a flexible coupling 86 that attaches to a pawl shaft 88 (see FIG. 5). The pawl shaft 88 passes through the rotor 74 and is retained with a retaining ring 90 at an end. The retaining ring 90 fits into a groove 91 in the pawl shaft 88. The pawl shaft 88 is free to rotate within the rotor 74. A larger, disk-like part of the pawl 92 has a slot 93 which allows the quill 34 to pass. A torsion spring wire 94 is attached between an aperture 95 in the disk of the pawl 92 and the rotor 74 that forces the interior edge of the pawl slot 93 to ride against the side of the quill 34. The quill 34 has a small groove 96 cut at the base of its shank that is just greater than the thickness of the pawl disk 92. When the quill 34 is forced to extend by the ramp 82, this groove 96 eventually reaches the pawl disk 92 and the torsion spring 94 forces the pawl 92 to snap into the groove 96. This retains the quill 34 in an extended, or "cocked", position even after it has passed beyond the end of the ramp. The quill 34 is thus retained in its extended state as long as the rotor 74 continues to turn in its free direction.

If the rotor 74 is subsequently turned in the reverse direction, the roller-clutch 80 will prevent its rotation. Since the pawl shaft 88 is free to rotate within the rotor 74, it will now turn back against the torsion spring 94 force and pull out of the groove 96 in the quill shank. This will release the quill 34 and it will snap back to its retracted position, releasing the guitar string 26.

Thus the servomotor 70 operation controls each pluck operation. The plucking rotor 74 is rotated until the quill 34 is cocked; the quill 34 is then turned against the string 26 to draw it back; when rotation is reversed, the quill 34 retracts and the string 26 is plucked. Since the amount that the string 26 is pulled is dependent on how far the rotor 74 is turned and this distance determines how much amplitude the resulting plucked vibration will have (and thus the volume produced) the servomotor 70 also has control over the loudness of each pluck.

Figure 6:
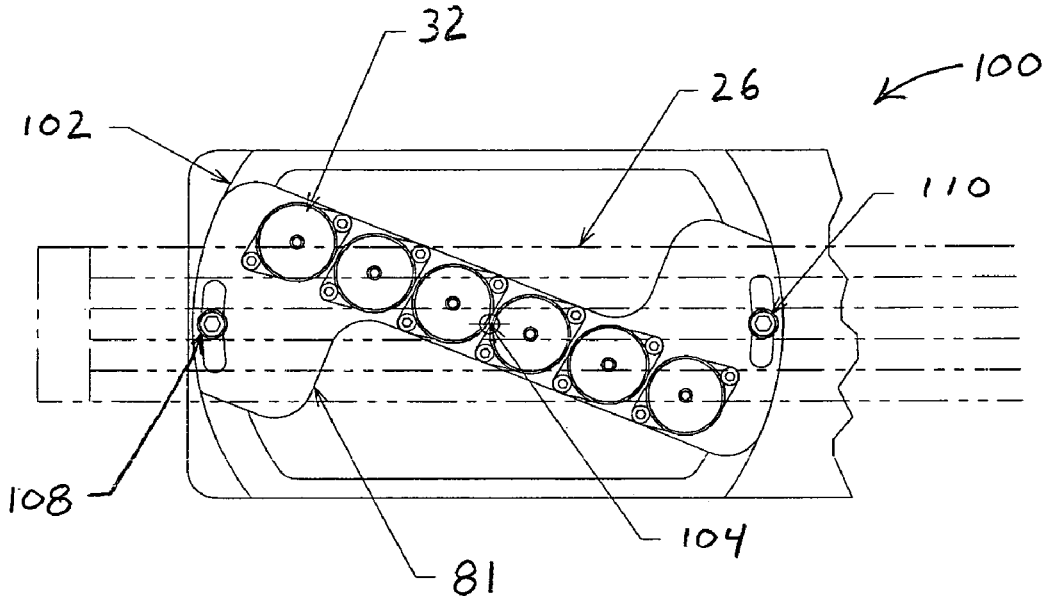
FIG. 6 is a plan view of an adjustment assembly.

Since there is no universal standard for the spacing between strings on instruments, such as guitars of different manufacture or style, the player includes an adjustment assembly 100 to adjust the spacing of the rotary pluckers 32 (see FIG. 6). All six plucking mechanisms of the preferred embodiment are mounted in an S-shaped housing 81. Outer edges of the S-shaped housing form circular arcs 102 with a common center. The entire adjustment assembly 100 is inserted into the lower frame 14 of the player, which includes similar circular arcs. This allows the adjustment assembly to rotate about a point 104 at approximately its midpoint. The row of pluckers 32 is situated at an angle that is skew to the instrument strings 26. When located at the proper angle each plucking mechanism 32 will be located in its correct position over a corresponding string 26. As the assembly 100 is turned, the positions of the pluckers 32 relative to the strings 26 can be expanded or contracted, depending on the string spacing of a particular instrument. Once the plucker housing 81 is properly positioned with respect to the instruments strings 26, anchor screws 108, 110 are tightened to a fasten the housing 81 to the lower frame 14.

Neck Clamp

Figure 7:
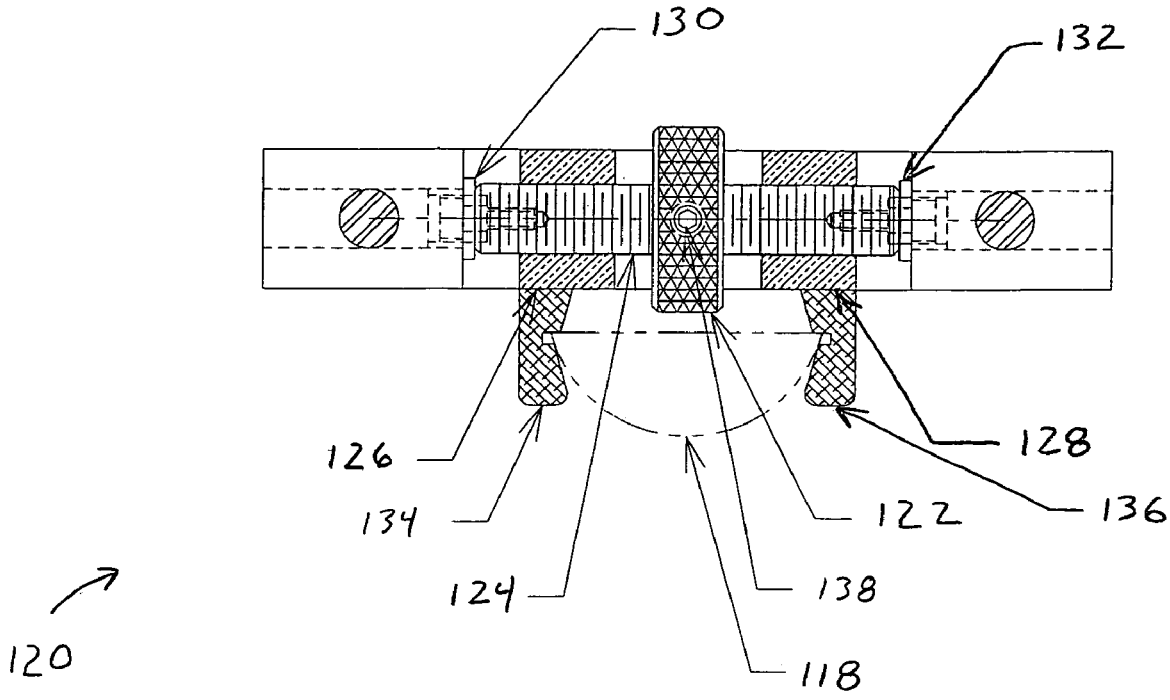
FIG. 7 is a view of a neck clamp.

The player is attached to the instrument neck 118 via a mounting arrangement including two clamping devices. Again, although the preferred player described herein is in reference to a player for a guitar, one skilled in the art will appreciate that the particular mounting arrangement will differ between different stringed instruments. A first neck clamp 20 is part of the upper frame 12; a second neck clamp 121 art of the lower frame 14. Both neck clamps function identically. Each neck clamp (see FIG. 7) comprises a thumbwheel 122 attached to the center of a leadscrew shaft 124, which is threaded into two clamping nuts 126, 128. The ends of the leadscrew shaft ride freely in two bronze bushings 130, 132. One half of the leadscrew is threaded with a normal right-hand helix; the other end has left-hand threads. In this way, when the thumbwheel is turned, the clamping nuts will expand away from each other, or contract together, depending on the direction of rotation. To these nuts are attached clamping jaws 134,136 that squeeze the guitar neck 118 and rigidly hold the device at its proper height from the strings. Once the clamping jaws 134, 136 have been set, a set screw 138 is provided in thumbwheel 122 to lock the lead screw 124 and the and the clamping jaws 134, 136 in place.

Operation

The player is designed for use on any stringed instrument, such as guitars, without any modifications to the instrument. An embedded electronic circuit 140 controls the stepper motors and solenoids and operates them in sequence to produce the pre-programmed music. A detachable electric cord and AC adapter connects the device to any 120 V a/c outlet. Music programs may be installed in RAM memory via a serial connection that can connect to a computer or other MIDI device.

What is claimed is:

1. An automated player for playing an unmodified stringed instrument comprising:

at least one plucking mechanism operable to selectively and releaseably contact and displace a corresponding instrument string such that the instrument string vibrates and produces a sound, and wherein said plucking mechanism further comprises a string-contacting portion rotationally mounted relative to said corresponding instrument string and having a rotational axis substantially perpendicular to said corresponding instrument string, a first drive member in mechanical communication with said string-contacting portion and capable of creating relative motion between said string-contacting portion and said corresponding instrument string, a surface in communication with said string-contacting portion, said surface operably engaging said string-contacting portion, creating relative movement between said drive member and said string-contacting portion whereby said string-contacting portion is selectively extendable to vary the displacement of said string during rotation of said first drive member.

2. The automated player of claim 1 further comprising at least one fretting mechanism operable to selectively depress a corresponding instrument string such that vibration of the string occurs over a desired length, said fretting mechanism further comprising:

a carriage operable to be placed in depressive contact with said instrument string; and a second drive member in mechanical communication with said carriage capable of creating relative movement between said second drive member and the carriage, said second drive member operable to selectively position said carriage.

3. The automated player of claim 2 wherein the string contacting portion is comprised of a rotor having a rotational axis generally perpendicular to said instrument string and an aperture eccentric to said rotational axis;

a retractable spring-loaded quill being slidably disposed within said aperture;

a pawl shaft passing through and freely rotatable within said rotor, said pawl shaft having a disk portion with a slot for mechanical cooperation with said quill; and a torsion spring connecting said rotor and said pawl shaft.

4. The automated player of claim 3 wherein said first drive member is comprised of a first servomotor.

5. The automated player of claim 1 further comprising an electronic control circuit, said control circuit in electrical communication with said first drive member, said control circuit operable to selectively output signals to said first drive member to operate said plucking mechanism.

6. The automated player of claim 2 wherein said carriage is slidably disposed upon at least one rail, said carriage being attached to a belt in mechanical communication with a second drive member.

7. The automated player of claim 6 wherein said second drive member is a second servomotor.

8. The automated player of claim 6 wherein said carriage is further comprised of at least one actuator, said actuator operating a finger which makes depressive contact with a corresponding instrument string.

9. The automated player of claim 8 wherein said first and second drive mechanisms comprise servomotors and said actuator comprises an electric solenoid.

10. The automated player of claim 8 further comprising an electronic control circuit, said electronic control circuit being in electrical communication with said actuator and said second drive member, said control circuit operable to selectively output signals to said actuator and said second drive member to operate fretting mechanism.

11. The automated player of claim 10 further comprising an even number of carriages, said carriages each being in mechanical communication via a belt to said second drive member, said carriages being driven in pairs by pulleys having a ratio of 17:18.

12. The automated player of claim 8 further comprising an electronic control circuit, said electronic control circuit being in electrical communication with said actuator and said first and second drive members, said control circuit operable to selectively output signals to said actuator and said first and second drive members to operate said plucking and said fretting mechanisms.

13. The automated player of claim 12 wherein said electronic control circuit is connected to a computing device containing pre-programmed music.

14. The automated player of claim 12 further comprising:

a first frame member and a second frame member, said at least one rail connecting said first and second frame members; and a clamp attached to at least one of said first frame member or said second frame member, said clamp rigidly securing said player to said instrument.

15. The automated player of claim 14 wherein said clamp comprises:

a leadscrew having a thumbwheel, said leadscrew being threaded into a first clamping nut and a second clamping nut;

a first and a second clamping jaws, said first and second clamping nuts being attached to said first and second clamping jaws respectively such that when said thumbwheel is turned rotating the leadscrew in a first direction, said first and second clamping jaws move away from each other, conversely when said thumbwheel is turned rotating said leadscrew is a second direction opposite to said first direction, said first and second clamping jaws move toward each other until said first and second clamping jaws contact said instrument thereby rigidly securing said player to said instrument.

16. The automated player of claim 14 further comprising a plucker housing for supporting said at least one plucking mechanism, said plucker housing having a roller clutch for each of said at least one plucking mechanism wherein said roller clutch receives said plucking mechanism rotor, allowing said rotor to rotate only in a first direction.

17. The automated player of claim 16 wherein said plucker housing further comprises an adjustment assembly having a midpoint, said adjustment assembly comprising:

arcs on outer edges of said plucker housing;

corresponding arcs on said first frame member for receiving said plucker housing arcs, whereby said plucker housing arcs and said first frame member arcs cooperate to allow said adjustment assembly to rotate about a point at approximately the midpoint of said adjustment assembly, as said adjustment mechanism is rotated, said at least one plucking mechanism moves relative to said corresponding instrument string; and at least one anchor to secure said plucker housing to said first frame member.

18. The automated player of claim 17 wherein a plurality of plucking mechanisms are positioned within said plucker housing in a line that is skew to said instrument strings.

19. The automated player of claim 17 wherein said anchor comprises a set screw.

20. An automated player for playing an unmodified stringed instrument comprising:

a first frame member;

a second frame member, said first and second frame members being connected by a first rail and a second rail, said first and second rails being spaced apart and substantially parallel to each other;

a fretting mechanism comprising a plurality of carriages, said carriages being slidably attached to at least one of said first rail or said second rail whereby said carriages slide on one of said first rail or said second rail, with each carriage having a plurality of actuators, each actuator operating a finger to depress a corresponding instrument string;

a corresponding belt fastened to each of said plurality of carriages, said belt being driven by a fretting servomotor connected to a first drive pulley and said belt also being supported by a second pulley;

a plurality of plucking mechanisms, each plucking mechanism being dedicated to one of said plurality of corresponding instrument strings, each plucking mechanism including a rotor having a rotational axis generally perpendicular to said instrument string and an aperture eccentric to said rotational axis, a retractable spring-loaded quill, said quill being slidably disposed within said aperture, a pawl shaft passing through said rotor and freely rotatable within said rotor, said pawl having a disk portion, said disk portion having a slot for mechanical cooperation with said quill, a torsion spring connecting said rotor and said pawl shaft, and a plucker servomotor driving said pawl shaft causing rotation of said rotor;

a plucker housing for supporting said plurality of plucking mechanisms in a line skew to said corresponding instrument strings, said plucker housing being adjustably mounted to said lower frame by an adjustment mechanism, said plucker housing having a roller clutch for each of said plurality of plucker mechanisms wherein said roller clutch receives said plucker mechanism rotor, allowing said rotor to rotate only in a first direction; and a control circuit for controlling the direction of rotation of said plucker servomotor, wherein said quill is naturally disposed in a retracted position within said rotor, said plucker servomotor receiving a signal from said control circuit rotates freely in said first direction, said quill head portion being in contact with an inclined surface slidably moves said quill into an extended position as said quill head portion traverses said inclined surface, said slot mechanically cooperating with said quill maintains said quill in said extended position, while rotating in said first direction said quill mechanically cooperates with and selectively displaces said instrument string, whereupon receiving a control signal said plucker servomotor rotates in a second direction opposite to said first direction, said roller clutch preventing said rotor from rotating in said second direction allows said pawl to rotate within said rotor in said second direction rotating said disk portion out of mechanical cooperation with said quill allowing said quill to return to said retracted position releasing said instrument string causing said string to vibrate producing a sound.

21. The automated player of claim 20 wherein said adjustment mechanism comprises:

arcs on outer edges of said plucker housing;

corresponding arcs on said first frame member for receiving said plucker housing arcs, whereby said plucker housing arcs and said first frame member arcs cooperate to allow said adjustment assembly to rotate about a point at approximately the midpoint of said adjustment assembly, as said adjustment mechanism is rotated, said plurality of plucking mechanism moves relative to said corresponding instrument string; and at least one anchor to secure said plucker housing to said first frame member.

22. The automatic player of claim 20 further comprising a clamp for attaching said player to said stringed instrument, said clamp being attached to at least one of said upper frame or said lower frame comprising:

a leadscrew having a thumbwheel, said leadscrew being threaded into a first clamping nut and a second clamping nut;

a first and a second clamping jaws, said first and second clamping nuts being attached to said first and second clamping jaws respectively such that when said thumbwheel is turned rotating the leadscrew in a first direction, said first and second clamping jaws move away from each other, conversely when said thumbwheel is turned rotating said leadscrew is a second direction opposite to said first direction, said first and second clamping jaws move toward each other until said first and second clamping jaws contact said instrument thereby rigidly securing said player to said instrument.

23. The automated player of claim 20 wherein said plurality of carriages comprises an even number, said carriages each being in mechanical communication via a belt to said second drive member, said carriages being driven in pairs by pulleys having a ratio of 17:18.

24. The automated player of claim 20 further comprising an electronic control circuit, said electronic control circuit being in electrical communication with said actuator and said plucker servomotor and said fretting servomotor, said control circuit operable to selectively output signals to said actuator and said plucker servomotor and said fretting servomotor to operate said plucking and said fretting mechanisms.

25. The automated player of claim 24 wherein said electronic control circuit is connected to a computing device containing pre-programmed music.

* * * * *